United States Patent [19]

Bourgeois

[11] 4,147,042

[45] Apr. 3, 1979

[54] SELECTION MECHANISM OF CIRCULAR KNITTING-MACHINE

[75] Inventor: Norbert P. Bourgeois, Troyes, France

[73] Assignee: ASA S.A., Roanne, France

[21] Appl. No.: 821,835

[22] Filed: Aug. 4, 1977

[30] Foreign Application Priority Data

Aug. 6, 1976 [FR] France ..... 76 24347

[51] Int. Cl.[2] ..... D04B 15/68

[52] U.S. Cl. ..... 66/231; 66/241; 66/230

[58] Field of Search ..... 66/25, 50 R, 50 B, 75.1

[56] References Cited

U.S. PATENT DOCUMENTS

| | | | |
|---|---|---|---|
| 2,259,897 | 10/1941 | Lawson | 66/50 R |
| 3,620,047 | 11/1971 | Paepre | 66/25 |
| 3,678,710 | 7/1972 | Gostelow | 66/50 R X |
| 3,835,668 | 9/1974 | Schiebel et al. | 66/50 R X |
| 3,863,465 | 2/1975 | De Cerjat et al. | 66/50 R |
| 3,930,383 | 1/1976 | Nuber | 66/25 |

FOREIGN PATENT DOCUMENTS

| | | | |
|---|---|---|---|
| 42139 | 12/1969 | Fed. Rep. of Germany | 66/50 R |
| 2414934 | 10/1975 | Fed. Rep. of Germany | 66/50 R |
| 2515201 | 10/1976 | Fed. Rep. of Germany | 66/75.1 |

*Primary Examiner*—Wm. Carter Reynolds
*Attorney, Agent, or Firm*—Arnold, White & Durkee

[57] ABSTRACT

Mechanism for selecting and controlling needles of circular knitting machine wherein, at each feed of the knitting machine, there is provided a cam path in which is engageable an outwardly projecting butt on an axially reciprocable needle to reciprocate the needle. An activating swing jack is pivoted to the bottom of the needles and a selector jack is pivoted to the unit and is operatively associated with the activating swing jack. A selector butt and a complementary eraser butt on the selector jack are respectively positively engaged by a selector lever and an eraser lever, the selector lever moving the jacks and hence the needles whereby the needle butts engage in the cam path while the eraser lever move the jacks and hence the needles, whereby the needle butts are disengaged from the cam path, respectively to bring the needle into its operative and inoperative condition. The selector and eraser levers cooperate with the selector and eraser butts of the selector jack over the entire length of the feed.

5 Claims, 7 Drawing Figures

SELECTION MECHANISM OF CIRCULAR KNITTING-MACHINE

The present invention relates to improvements in the selection mechanisms of circular knitting machines. The main purpose of these improvements is to enable the speed of rotation of the knitting machine to be increased by reducing the time required for selecting each knitting element, by positively guiding these knitting elements over the entire length of each feed, and by preventing non-operating needles (miss needles) from colliding heavily with the stitch cams.

The knitting element normally used in the needle cylinder is a needle having an outwardly projecting butt adjacent to which is a selector jack comprising a selector butt designed to cooperate with one of the selector levers of a selector mechanism consisting mainly of a series of such levers superposed one above the other. The selector butts of the consecutive selector jacks are arranged in a staggered formation, either diagonally or in minor repeat, so that each selector jack can be acted upon by only one selector lever.

The pattern is made up by hand on the selector mechanism by placing certain selector levers in a position such that they are able to cooperate with the selector jacks, of which the selector butts are situated in one and the same horizontal plane the others being held in a non-operative position. A selector mechanism is generally provided at each feed.

Also associated with each feed is cam which is located at the bottom of the needle cylinder and which acts on the rear ends of all those selector jacks which have been brought into engagement with the needle raising cam, so that they are in the operating position. Those selector jacks of which the butt is acted upon by a selector lever are moved innto the interior of the slot of the cylinder, thus avoiding the raising cam, and the associated needles are brought into a non-operating or miss position. On the other hand, those selector jacks, of which the butts are not pushed by a selector lever, continue to be acted upon by the raising cam, and the corresponding needle is raised into the operating position. Thus, selection takes place in two stages:

first, the set of selector jack butts are brought into engagement with the raising cam, then, those selector jack butts are not required to bring the associated needles into the operating position are caused to move into the interior of the slot of the cylinder by the corresponding selector lever.

Such a mechanism is described in particular in German Patent Application No. 1,635,946 and in U.S. Pat. No. 3,747,371.

This two-stage method of selection suffers from a number of disadvantages, and in particular the following:

when a needle is to remain out of operation in a number of consecutive feeds, the associated selector jack is nevertheless brought into contact with the raising cam at each of these feeds and is then moved into the cylinder by the corresponding selector lever. These needless movements take time and cause wear on the selector jack.

furthermore, this two-stage selection procedure requires a relatively great amount of time which is increasingly incompatible with the speeds at present called for in knitting machines, Also, the cam that acts on the rear ends of the selector jacks has to be accommodated in each feed and this poses a problem in the present day multi-feeder knitting machines wherein space becomes increasingly reduced as the number of feeds increases, and finally, the butts of the non-operating needles still strike the bottom of the stitch cam, and this causes an impact which, since it is repeated particularly at a high speed of rotation, can damage the hook of the needle and can cause stretching of the stitch carried by the needles so that the appearance of the knitted material is spoiled, and thread-breakages may even occur when fragile yarns are been knitted.

French Pat. No. 2,211,947 and German Patent Application 2,008,822 disclose a somewhat different selection method wherein the needle is controlled by means of an oscillating selector jack having a guide butt at each end and, between its two ends, a selector butt cooperating with one of the levers of the selector mechanism. One of the guide butts engages with the raising cam when the corresponding needle is to be raised into the operating position, and the other guide butt cooperates with a guide path if the needle is not to knit. In each knitting unit and in the path of the first butt there is provided an eraser cam which cancels the selection and which moves all the selector jacks out of the range of the raising cam. Those selector jacks that are acted upon by a selector cam rock back into the operating position whereas the others remain in the rest position.

The mode of operation is the reverse of the conventional, but it still suffers from some of the usual disadvantages, namely:

The cancellation of the selection at each knitting unit, even in the case of needles that are to continue to knit, entails needless movements of the selector jacks, the selection procedure is still carried out in two stages and therefore occupies a fairly lengthy period, and the need for introducing an additional cam in each system and in the path of the selector jacks results in the difficulty of finding room therefore in multi-feeder knitting machines. It is still more difficult to provide this space in a path already accomodating several cams than to provide it below the cylinder as is the case in the earlier arrangement described above.

The main advantage of this arrangement is the presence of the two guide butts on the selector jack, which butts enable the lifting of the needles into the operating position and the maintenance of the needles into the non-operating position to be carried out in two separate cam paths. Thus, the risk of accidents, stemming from impact of the needles in the non-operating position on the stitch cam, is eliminated.

According to the present invention there is provided a mechanism for selecting and controlling the needles of circular knitting machine comprising, at each feed of the knitting-machine, a cam path, a knitting needle, an outwardly projecting butt on the needle selectively engageable in said cam path, an activating swing jack pivoted to the bottom of the needle, a selector jack operatively associated with this activating swing jack, a selector butt and a complementary eraser butt on said selector jack, said butts each forming one of a series of butts on adjacent jacks, a selector lever positively engaging the selector butt and an eraser lever positively engaging the eraser butt, said levers each forming one of the series of such levers, the selector levers moving the jacks and hence the needles, whereby the needle butts engage in the cam path to bring the needle into an operative condition, while the eraser levers move the jacks and hence the needles whereby the needle butts are disengaged from the cam path to bring the needle into its inoperative condition, the selector and eraser levers cooperating with the selector and eraser butts of the selector jack over the entire length of the feed.

Such a construction enables the speed of rotation of knitters to be increased. This is achieved, on the one hand, by increasing the speed of selection and by carrying out selection in a single stage and, on the other hand, by causing the knitting elements to operate in conditions such that their movements are positively controlled over the entire length of the feed, this being achieved by guiding the butts of the selector jacks over the entire length of the knitting position, this being done when the needles are held in the non-operating position as well as when they are held in the operating position.

According to the invention, the selector jack terminates, at its top, in a fork in which the lower butt of the intermediate jack is locked when the needle is in the non-operating position. This ensures that the needles are retained during the whole of the period in which they are in the non-operating position.

In a preferred arrangement, the selector jack is articulated, midway along its length, in the insertable trick wall and can thus rock to bring the needles either into the operating position or into the non-operating position.

Finally, as previously stated the needles are held in the operating position by means of selector levers which cooperate with the butt on the selector jacks over the entire length of the feed.

The following description relates to the invention as applied more particularly to the selection and control of needles situated in the cylinder of a circular knitting-machine. It is obvious that the invention is not limited to this application and that it could also be used in the selection and control of needles carried by the dial of a circular knitting-machine.

The invention will be better understood from the following description, which is given, merely by way of example, reference being made to the accompanying drawings, in which.

Figure 1:
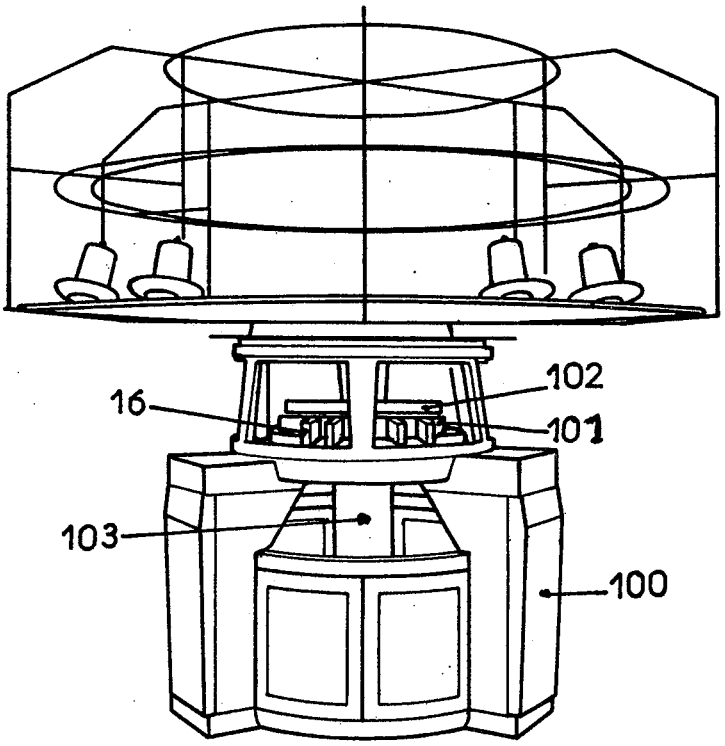
FIG. 1 illustrates diagrammatically a circular knitting machine comprising a plurality of feeds, each feed being provided with one embodiment of mechanism for selecting and controlling needles, in accordance with the invention.

FIG. 1 illustrates diagrammatically a conventional multi-feeder circular knitting machine provided at each position, with a mechanism for selecting and controlling the needles. Since this is a well-known type of knitting machine it will not be described in detail herein. It consists mainly of a frame 100 on which are mounted, on the one hand, a needle cylinder 101 and a needle dial 102 comprising a plurality of slots in which slide the knitting needles which are controlled in the conventional manner by sets of cams. The entire system is driven by a motor, not illustrated, which causes the needle cylinder 101 and dial 102 to rotate, and the fabric 103 is rolled on a device, likewise not illustrated, which is driven in synchronism with this rotation.

According to the invention, each feed is provided with a mechanism 16 for selecting and controlling the needles.

This is illustrated in greater detail in FIGS. 2 to 7.

Each position 1 of the cylinder with insertable tricks walls 2 of the circular knitting machine is provided with a needle 3 associated with an activating swing jack 4 and with a selector jack 5. The needle 3 has an outwardly projecting butt 6 designed to cooperate with a cam path **7*a* which controls the needles over the entire length of the feed within the limits of the operating positions (FIGS. 3 and 6) and of the non-operating positions (FIGS. 5 and 7), and has at its base a cavity 8 of circular shape in which a hook shaped head of the swing jack 4 is articulated. This swing jack has at its madian zone a butt 9 which cooperates with a cam path 7*b*, and at its bottom a butt 10 which, when the associated needle 3 is to remain in the non-operating position, becomes locked in the fork 11 formed at the top of the selector jack 5. Midway along its length, this selector jack 5 has a pivoting means 12 whereby the jack 5 is articulated on the trick 13 of the section 1 of the cylinder with insertable trick walls 2 of the knitting machine. The jack 5 can be readily disconnected from the trick 13, and all that is required for the purpose is to deform the resilient portion 14 of the trick 13 in a direction tangential to the cylinder 2. Thus a damaged jack can be readily changed. Articulation of the selector jack 5 on the trick 13 prevents the jack from being moved in the vertical direction. It can oscillate in the section 1 only about the pivot point 12 in a plane parallel to the trick 13. This movement is of very small amplitude so that wear on the part is reduced. The jack 5 carries eraser butts 15*a* and complementary selector butts 15*b*, which are arranged symmetrically in relation to the articulation point 12 and which cooperate respectively with the levers 17*a* and 17*b* of the selector blocks 16*a* and 16*b***.

Each selector block **16*a* and 16*b* consists of a set of eraser levers 17*a* and selector levers 17*b*. These levers are symmetrically arranged in relation to the butts of the selector jack 5. These butts, such as those shown at 15*a* and 15*b*, are provided on the various jacks in a staggered arrangement. Each selector jack 5 thus has an eraser butt 15*a* at a given height and a selector butt 15*b* arranged symmetrically in relation to the pivot point 12**.

Figure 3:
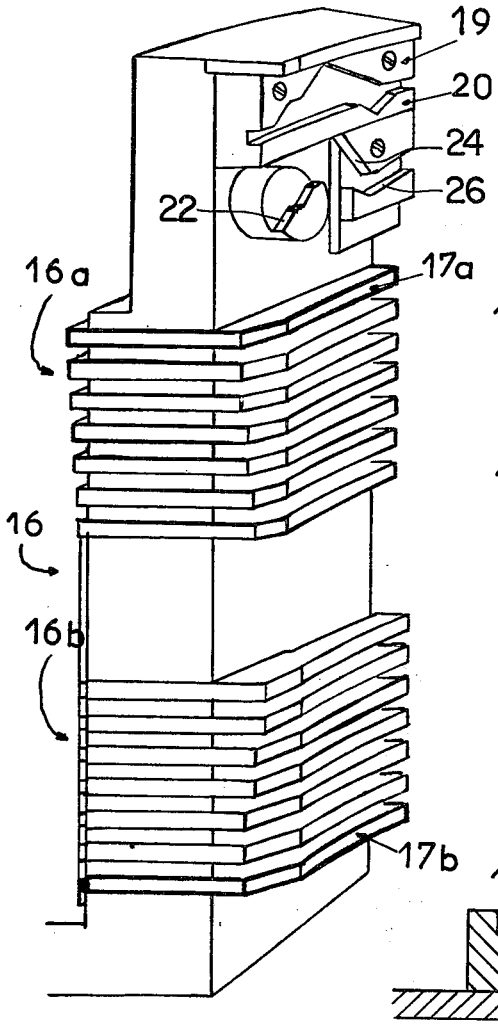
FIG. 3 is a perspective view of a knitting unit with the selector levers, the selector jack, the activating swing jack and the needle in the operating.
Figure 2:
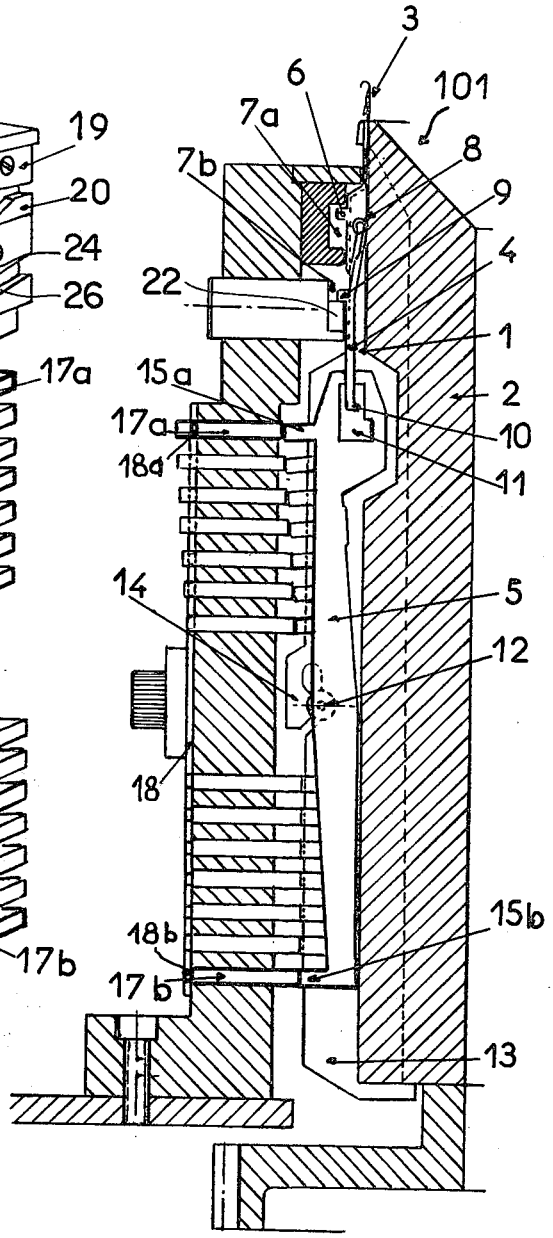
FIG. 2 is a sectional side view of the knitting element in its cylinder slot, the cam paths cooperating with the various control butts and the sets of selector levers, the needle being shown in its operating position.
Figure 5:
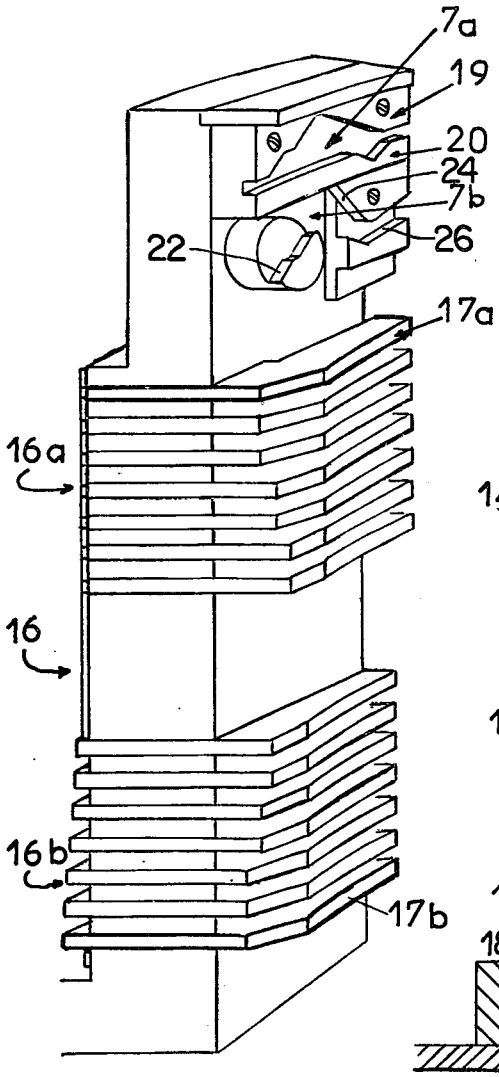
FIG. 5 is similar to FIG. 3; but with the eraser levers moving the various parts to the non-operating position.
Figure 4:
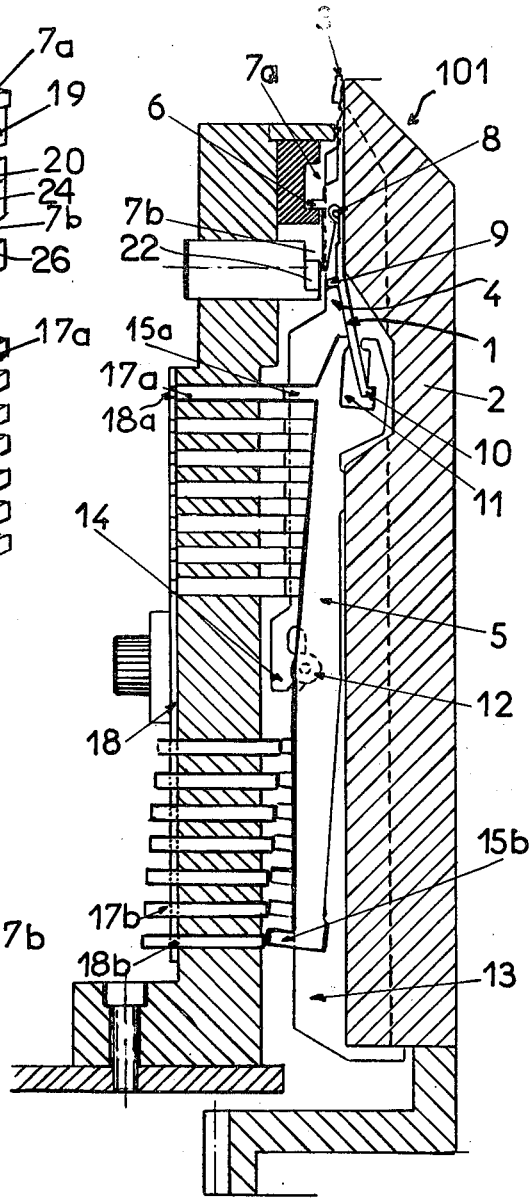
FIG. 4 is similar to FIG. 2, but with the parts shown in the non-operating position.
Figure 6:
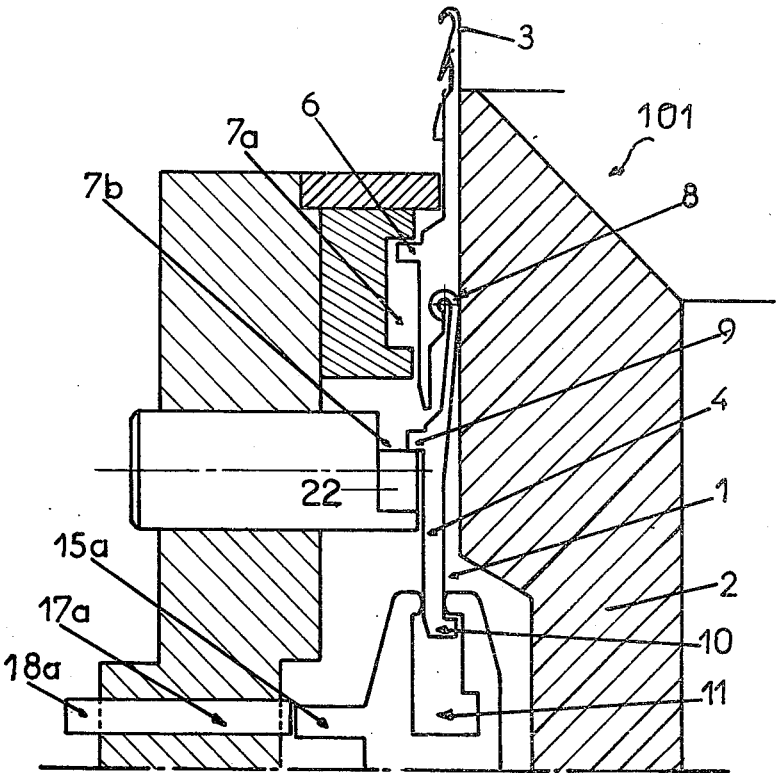
FIGS. 6 and 7 are views, on a larger scale, showing parts of FIGS. 2 and 4 illustrating more precisely the manner in which the needle is held in the operating position (FIG. 6) and in the non-operating position (FIG. 7).
Figure 7:
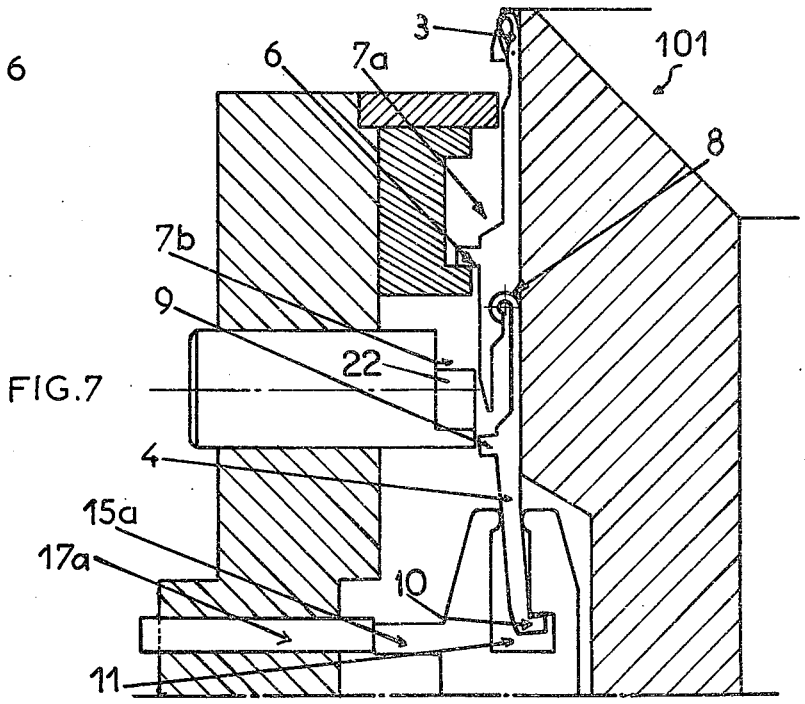

Referring to FIGS. 2, 3 and 6, i.e., in the case where the needle 3 in question is operating, the selector lever **17*b* is extended from the block 16*b* and thus causes the selector butt 15*b* of the selector jack 5 to move into the slot 1 of the cylinder 2. The jack 5 rocks about the pivot point 12 and takes up a position such that the eraser butt 15*a* moves out of the slot 1 and bears against the eraser cam 17*a*. The fork 11 at the top of the jack 5 moves into a vertical position such that the butt 10 of the swing jack 4 is released. The butt 9 of the swing jack 4 then cooperates with the cam path 7*b*, formed by the cams 22, 24**, and 26, to cause the needle 3 to move up into the operating position. The cam 22 causes the needle 3 to initially move up into the operating position, while the cams 24 and 26, in cooperation with the butt 9, guide the needle 3 in the descending portion of its travel. The operation of the butt 9 in cooperation with the cams 22, 24, and 26 is conventional and well known in this art. Consequently, a detailed discussion of this portion of the machine's operation is not necessary. The butt 6 of the needle 3 is guided over the entire length of the feed for the mechanism 16 shown in FIG. 3 by the cam 19 in the path 7*a*.

The levers 17 are so shaped (FIG. 3) that they are in positive contact with the butt 15 of the selector jack 5 over the entire length of the feed, thus ensuring positive control of the jack during the entire duration of the selection operation which remains constant as long as the levers 17*a* and 17*b* are disposed in the manner illustrated in FIG. 2.

When the selector jack 5 passes in front of a selector block 16*a* where the eraser lever 17*a* is extended (FIG. 5), the lever 17*a* pushes the butt 15*a* into the slot 1 of the cylinder 2. The selector jack 5 rocks about its pivot point 12 and drives the swing jack 4, the butt 9 of which moves out of the cam path 7*b*. The butt 10 becomes locked in the fork 11, and the needle 3 in the non-operating position is held in this position over the entire length of the feed, on the one hand because the butt 10 becomes hooked in the fork 11, and on the other hand because of the presence of the cam 20 of the path 7*a*.

The selector cams are positioned in dependence upon the pattern to be formed, and they are held in position in known manner by means of a pattern key 18, the teeth of which can be disposed in a complementary manner, that is to say that if, for example, the tooth 18*b* as been retracted, the tooth 18*a* cannot be (FIG. 4) and vice versa (FIG. 2).

Compared with the existing arrangement, the mechanism in accordance with the invention offers, as previously stated, numerous advantages, of which the main ones are very short selection time and, in particular, the avoidance of load on the needles except when they are operating, whereas they are held in position in a perfectly efficient manner when they are not operating.

As previously stated, it is obvious that the invention is not limited to selecting the needles of a cylinder of a knitting machine, but it may also be used for selecting the needles of the dial.

What we claim is:

1. A mechanism for selecting and controlling the needles of a circular knitting machine comprising, at each feed of the machine:

a knitting needle;

a cam path;

a swing jack pivoted to the bottom of the needle;

a projecting butt disposed on the swing jack and selectively engageable with said cam path;

a selector jack operatively associated with the swing jack;

a selector butt and a complementary eraser butt symmetrically disposed on said selector jack about its midpoint;

a selector lever positively engaging the selector butt, the selector lever adapted to move the selector jack and hence the swing jack, whereby the swing jack butt engages the cam path to bring the needle into an operative position; and an eraser lever positively engaging the eraser butt, the eraser lever adapted to move the selector jack and hence the swing jack, whereby the swing jack butt is disengaged from the cam path to bring the needle into an inoperative position, the selector and eraser levers cooperating with the selector and eraser butts of the selector jack over the entire length of the feed.

2. The mechanism of claim 1, further comprising:

a fork disposed at the top of the selector jack; and a lower butt disposed at the bottom of the swing jack and adapted to engage said fork, whereby the lower butt is located in the fork when the needle is in the inoperative position.

3. The mechanism of claim 1, wherein the selector jack is pivoted at its midpoint, so that the selector jack may pivot to bring the needle into the operative position or into the inoperative position.

4. The mechanism of claim 1, further comprising:

a guide cam path; and a guide butt projecting from said needle and engageable with said guide cam path, thereby providing for the axial movement of said needle.

5. An improved selection mechanism for the needles in a circular knitting machine of a type including a swing jack pivoted to the base of each needle for moving the needle to an operative or an inoperative position, wherein the improvement comprises:

a selector jack having an upper end operatively associated with a lower end of said swing jack;

a first selector butt disposed on said selector jack;

a first selector lever adapted to selectively engage said first selector butt and thereby cause said needle to move to an operative position;

a second selector butt disposed on said selector jack;

a second selector lever adapted to selectively engage said second selector butt and thereby cause said needle to move to an inoperative position;

a fork disposed on the upper end of said selector jack; and a locking butt disposed at the lower end of said swing jack and adapted to engage said fork and thereby lock said needle in the inoperative position when said second selector lever engages said second selector butt.

* * * * *

UNITED STATES PATENT AND TRADEMARK OFFICE

CERTIFICATE OF CORRECTION

PATENT NO. : 4,147,042

DATED : April 3, 1979

INVENTOR(S) : NORBERT P. BOURGEOIS

It is certified that error appears in the above-identified patent and that said Letters Patent are hereby corrected as shown below:

Column 1, line 37, delete "innto" and insert --into--.

Column 1, line 47, after "butts" insert --that--.

Column 2, line 13, delete "been" and insert --being--.

Column 3, line 26, delete "in" and insert --on--.

Column 5, line 35, delete "pattern" and insert --patter--.

Column 5, line 43, after "are" insert --a--.

Claim 2, line 5, delete "located" and insert --locked--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*